United States Patent [19]

Sando et al.

[11] Patent Number: 4,711,102

[45] Date of Patent: Dec. 8, 1987

[54] WET HEAT TREATING APPARATUS OF A CLOTH FOR PERFORMING DYEING AND WASHING IN COMBINATION

[75] Inventors: Yoshikazu Sando; Hiroshi Ishidoshiro, both of Wakayama, Japan

[73] Assignee: Sando Iron Works Co., Ltd.

[21] Appl. No.: 849,572

[22] Filed: Apr. 8, 1986

[51] Int. Cl.[4] ..... D06B 3/12

[52] U.S. Cl. ..... 68/5 E; 68/205 R

[58] Field of Search ..... 68/5 D, 5 E, 13 R, 62, 68/181 R, 205 R

[56] References Cited

U.S. PATENT DOCUMENTS

| | | | |
|---|---|---|---|
| 3,977,220 | 8/1976 | Clark et al. | 68/62 X |
| 4,092,839 | 6/1978 | Bahre et al. | 68/62 X |
| 4,150,449 | 4/1979 | Talbert | 68/181 R X |

FOREIGN PATENT DOCUMENTS

| | | | |
|---|---|---|---|
| 2521600 | 11/1976 | Fed. Rep. of Germany | 68/181 R |
| 38635 | 11/1971 | Japan | 68/62 |

*Primary Examiner*—Philip R. Coe

*Attorney, Agent, or Firm*—Toren, McGeady & Associates

[57] ABSTRACT

A wet heat treating apparatus of a long cloth for performing dyeing and washing in combination comprising a wet heat treating chamber provided with a cloth inlet and a cloth outlet at the bottom thereof, a ceiling with an acute-angled shape, liquid supply means for supplying a high pressure hot liquid to the cloth in the interior of the chamber, a pair of right and left guide roll groups arranged in up and down directions, a group of intermediate guide rolls positioned nearly at the middle of the right and left guide rolls, a transfer mechanism for moving the intermediate guide rolls to the direction of the right and left guide roll groups, and a doorway for an operator to go into and out of the chamber when cleaning the guide rolls. The cleaning of the guide rolls in the wet heat treating chamber can easily and surely be done, and therefore the dyeing and washing of a cloth can be done in combination with the use of a single apparatus satisfactorily.

2 Claims, 1 Drawing Figure

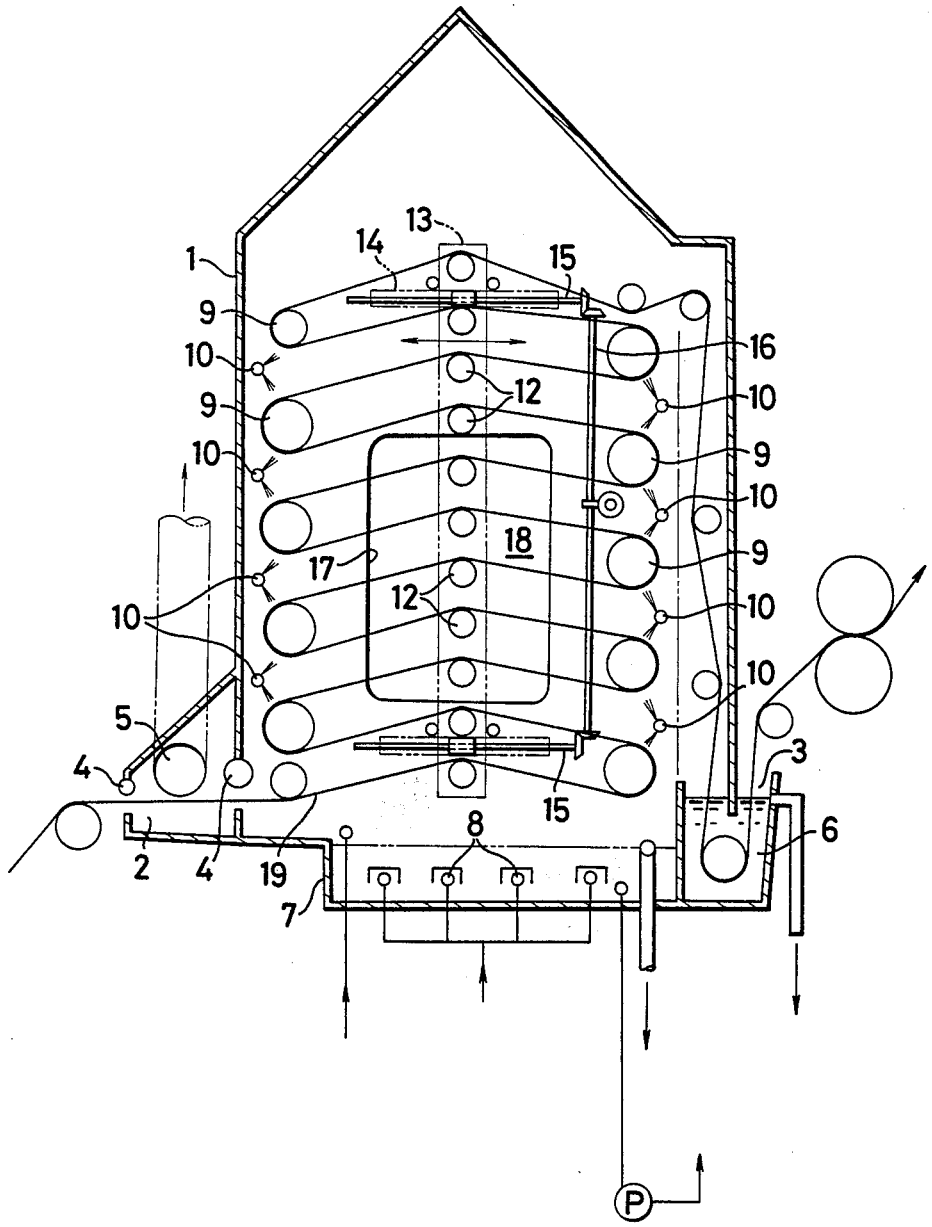
1
2
3
4
5
6
7
8
9
10
12
13
14
15
16
17
18
19
P

WET HEAT TREATING APPARATUS OF A CLOTH FOR PERFORMING DYEING AND WASHING IN COMBINATION

FIELD OF THE INVENTION AND RELATED ART STATEMENT

The present invention relates to an apparatus for wet heat treatment of a long cloth which can dye and wash the cloth in combination.

In subjecting a commercially produced long cloth such as knitted or woven one to dyeing or washing continuously, it has been a general practice to use a wet heat treating apparatus for dyeing or washing separately. In view of the above, the present inventors have developed a wet heat treating apparatus which can perform dyeing and washing in combination for the purpose of reducing the cost of plant and equipment and plant area. However, in such a wet heat treating apparatus for performing dyeing and washing in combination, since the dye applied to the cloth is adhered on the surfaces of a plurality of cloth guide rolls provided in the wet heat treating apparatus in the case when the apparatus is applied for dyeing in the first place, the dye adhered on the surfaces of the guide rolls is transferred to the cloth when such an apparatus is further used for washing successively, so that there occurs such a drawback that the cloth is stained. Further, when applying a light colored dye after the application of a deep colored dye, the deep colored dye adhered on the surface of the rolls is transferred to the cloth which is to be dyed with a light colored dye, so that there occurs stain of the cloth as in the preceding case.

OBJECT AND SUMMARY OF THE INVENTION

Under such circumstances, the object of the present invention is to offer a wet heat treating apparatus of a long cloth for performing dyeing and washing in combination, in which the cleaning operation of the guide rolls can easily be done when changing the operation from dyeing to washing or vice versa.

The characteristic feature of the apparatus comprises a wet heat treating chamber provided with a cloth inlet and a cloth outlet at the bottom thereof, a ceiling with an acute-angled shape, liquid supply means for supplying a high pressure hot liquid, i.e. a dye solution or washing water, to the cloth in the interior of the chamber, a pair of right and left guide roll groups arranged in up and down directions, a group of intermediate guide rolls positioned nearly at the middle of the right and left guide rolls, a transfer mechanism for moving the intermediate guide roll groups to the direction of the right and left guide roll groups, and a doorway for an operator to go into and out of the chamber when cleaning the guide rolls.

BRIEF EXPLANATION OF THE DRAWING

The drawing is an explanatory drawing showing an example of the present inventive apparatus.

DETAILED DESCRIPTION OF THE INVENTION

The present invention will be described in detail in the following with reference to the drawing showing an example of the inventive apparatus.

In the drawing, 1 is a vertical wet heat treating chamber. At the lower part of the wet heat treating chamber, a cloth inlet 2 and a cloth outlet 3 are provided for transporting a cloth to be treated continuously through the chamber. The cloth inlet 2 is provided with a heater 4 for preventing the water drain and an exhaust pipe 5, and the cloth outlet is provided with a liquid seal tank 6. The ceiling of the wet heat treating chamber is formed with an acute-shaped form for preventing water drain falling from the ceiling. 7 is a liquid tank provided at the bottom of the wet heat treating chamber in which a plurality of steam jet pipes 8 are provided for evaporating water introduced in the tank.

9 represents a plurality of guide rolls arranged in up and down directions in a double line for transporting a cloth introduced in the chamber upwards by forming right and left snaky undulations. 10 represents high pressure hot liquid jet nozzles provided between the adjacent guide rolls 9 for jetting a high pressure hot liquid to the cloth guided by the guide rolls 9. A treating solution is jetted from the nozzles 10, and hot water in the liquid tank 7 may also be jetted from the nozzle with the use of a pump (not shown in the drawing).

12 represents a plurality of intermediate guide rolls supported by a guide roll stand 13 provided in the position back and forth to the plane of drawing. The intermediate rolls 12 are in contact with the cloth guided by means of the right and left guide rolls 9 for preventing the formation of irregular selvages and serving as a water draining roll in washing. The guide roll stand 13 is supported with a pair of horizontal guides 14 provided up and down at the inner side of the wet heat treating chamber 1 so as to be movable only in the horizontal direction. The guide roll stand 13 is also clutched with a pair of screws 15, and the screws 15 are able to shift the guide roll stand 13 in the right and left directions by the operation of a handle (not shown in the drawing) provided outside of the wet heat treating chamber 1 for rotating a drive shaft 16. 17 is a doorway provided at the side wall of the chamber for an operator to go into and out of the chamber, and 18 is a door thereof. 19 is a cloth to be treated.

The construction of the apparatus in this example is as above described. Now, its function will be illustrated as follows.

A cloth 19 to be treated is transported through the wet heat treating chamber 1 by guiding with the guide rolls 9 and 12 while jetting a high pressure hot dye solution thereto from the high pressure hot liquid jet nozzles 10 for dyeing the cloth. When changing the operation from dyeing to washing by using the same apparatus, it is necessary to wipe off the dye adhered on the surfaces of the guide rolls 9 and 12. The wiping operation of the guide rolls is done manually by an operator entering the chamber through the doorway 17. However, the guide roll stand 13 becomes an obstacle for the operator to enter the chamber. Therefore, the operator can make it easier to enter the chamber by moving the guide roll stand 13 in the right or left direction with the use of a handle (not shown in the drawing) before entering the chamber. After the guide rolls 9 and 12 are cleaned by the operator, the cloth can be treated without stain when changing the operation from dyeing to washing or the application of from a deep colored dye to a light colored dye in the same apparatus.

In this way, with the use of the present inventive apparatus, the cleaning of the guide rolls in the wet heat treating chamber can easily and surely be done, and therefore, the dyeing and washing of a long cloth can be done in combination effectively with the use of a single apparatus without staining the cloth under the treatment.

We claim:

1. A wet heat treating appartus of a cloth for performing dyeing and washing where the apparatus can be changed over between dyeing and washing and where the apparatus can be cleaned in making the changeover, comprising an enclosed wet heat treating chamber having a pair of oppositely disposed and spaced apart substantially vertically extending side walls and a pair of oppositely disposed and spaced apart end walls extending transversely of said side walls, a ceiling forming an upper closure for said chamber and extending between said side walls, a cloth inlet in a lower part of one of said side walls and a cloth outlet in a lower part of the other of said side walls, a first group of substantially horizontal guide rolls located within said chamber and spaced apart in the vertical direction and located adjacent to the one said side wall and extending in the direction between said end walls, a second group of substantially horizontal guide rolls located within said chamber and spaced apart in the vertical direction and located adjacent the other said side wall and extending in the direction between said end walls, said second group of guide rolls located in paired horizontally spaced relation with said first group of guide rolls, a group of liquid supply means located within said chamber for supplying a high pressure hot liquid to the cloth guided to said chamber and passing over said first and second groups of guide rolls, a group of intermediate substantially horizontal guide rolls spaced apart in the vertical direction and spaced between and in paired relation with said first and second groups of guide rolls, means for supporting said group of intermediate guide rolls, a transfer mechanism for moving said supporting means and said group of intermediate guide rolls in generally the horizontal direction toward one or the other of said first and second groups of guide rolls, and a doorway in one of said end walls located in general alignment with said group of intermediate rolls whereby said group of intermediate rolls can be moved toward one of said first and second groups of guide rolls so that an operator can enter said chamber through said doorway for cleaning said groups of guide rolls without interference from said group of intermediate guide rolls.

2. A wet heat treating apparatus, as set forth in claim 1, wherein said supporting means comprises a vertically extending guide roll stand, and said transfer mechanism comprises a pair of horizontal guides spaced apart in the vertical direction for said roll stand, a screw for each of said horizontal guides, and a drive shaft engageable with said screws for moving said guide roll stand and said group of intermediate guide rolls between said first and second group of guide rolls.

* * * * *